US011287137B2

(12) United States Patent
Atemboski et al.

(10) Patent No.: US 11,287,137 B2
(45) Date of Patent: Mar. 29, 2022

(54) LOW-PROFILE EXHAUST AND AIR INTAKE SYSTEM FOR A DIRECT VENT FIREPLACE

(71) Applicant: Travis Industries, Inc., Mukilteo, WA (US)

(72) Inventors: Alan R. Atemboski, Renton, WA (US); Austin Atemboski, Renton, WA (US); Kurt W. F. Rumens, Kirkland, WA (US); William Ross Fotheringham, Everett, WA (US); Brian Wells, Arlington, WA (US)

(73) Assignee: Travis Industries, Inc., Mukilteo, WA (US)

( * ) Notice: Subject to any disclaimer, the term of this patent is extended or adjusted under 35 U.S.C. 154(b) by 393 days.

(21) Appl. No.: 16/438,399

(22) Filed: Jun. 11, 2019

(65) Prior Publication Data

US 2020/0393135 A1 Dec. 17, 2020

(51) Int. Cl.

| | |
|---|---|
| ***F24B 5/02*** | (2006.01) |
| ***F23J 11/00*** | (2006.01) |
| ***F24B 1/18*** | (2006.01) |

(52) U.S. Cl.

CPC ..... *F24B 5/028* (2013.01); *F23J 11/00* (2013.01); *F24B 1/1808* (2013.01)

(58) Field of Classification Search

USPC ..... 126/80

See application file for complete search history.

(56) References Cited

U.S. PATENT DOCUMENTS 6,776,704 B2 * 8/2004 Goncalves ..... F24F 7/00 454/8

2020/0284436 A1 * 9/2020 Fong ..... F24C 15/002

* cited by examiner

*Primary Examiner* — Steven B McAllister
*Assistant Examiner* — John E Bargero
(74) *Attorney, Agent, or Firm* — Perkins Coie LLP

(57) ABSTRACT

An exhaust and air intake system for a direct vent fireplace. A low-profile manifold assembly is coupled to a direct vent fireplace and is configured to receive exhaust gases from the fireplace and expel the exhaust gases outside of the building in which the fireplace is located. The manifold assembly also takes in fresh air from outside of the building and provides the fresh air to the fireplace to use during combustion. The manifold assembly includes separate chambers for the exhaust gases and the fresh air so that the exhaust gases and the fresh air do not mix together within the manifold assembly. Several pressure reduction and equalization structures are incorporated into the manifold assembly to regulate the amount and pressure of fresh air provided to the fireplace.

18 Claims, 7 Drawing Sheets

LOW-PROFILE EXHAUST AND AIR INTAKE SYSTEM FOR A DIRECT VENT FIREPLACE

TECHNICAL FIELD

Embodiments of the present technology are directed to fireplace assemblies, and more particularly, to exhaust and air intake systems for gas-burning fireplaces.

BACKGROUND

Fireplaces are popular features of homes, apartments, condominiums, hotels, office buildings, and other buildings. One common type of fireplace is a direct vent fireplace system in which combustion air is drawn into the firebox from outside of the building using ducting coupled between the firebox and the ambient outside air. In gas-burning fireplaces, the combustion air can be mixed with a fuel (e.g., natural gas, propane, etc.), and the mixture is provided to a burner assembly in the firebox and burned to produce an aesthetically pleasing flame arrangement. The resulting heat is used to heat air surrounding the firebox. These fireplace systems also include exhaust systems with ducting fluidly coupled to the firebox and that directs exhaust gases away from the fireplace assembly and out of the building. Accordingly, direct vent fireplace systems typically include separate sets of ducting for providing combustion air and for removing exhaust. However, the separate ducting systems can require significant space. In some situations, such as renovating an existing multi-story building (e.g., an apartment and/or condominium building, a hotel, an office building, etc.), suitable space for conventional systems may not be available. Alternatively, the retrofit of existing structures and the installations of conventional fireplace units can be extremely expensive and labor intensive. Accordingly, there is a need for an improved exhaust and air intake system that overcomes drawbacks of the prior art and that provides other benefits.

BRIEF DESCRIPTION OF THE DRAWINGS

Embodiments of low-profile exhaust and air intake systems introduced herein may be better understood by referring to the following Detailed Description in conjunction with the accompanying drawings, in which the reference numerals indicate identical or functionally similar elements.

DETAILED DESCRIPTION

The present disclosure describes exhaust and air intake systems and assemblies for direct vent fireplace systems, such as gas-burning, direct vent fireplace systems. Several specific details of the technology are set forth in the following description and the Figures to provide a thorough understanding of certain embodiments of the technology. One skilled in the art, however, will understand that the present technology may have additional embodiments, and that other embodiments of the technology may be practiced without several of the specific features described below.

Figure 1A:
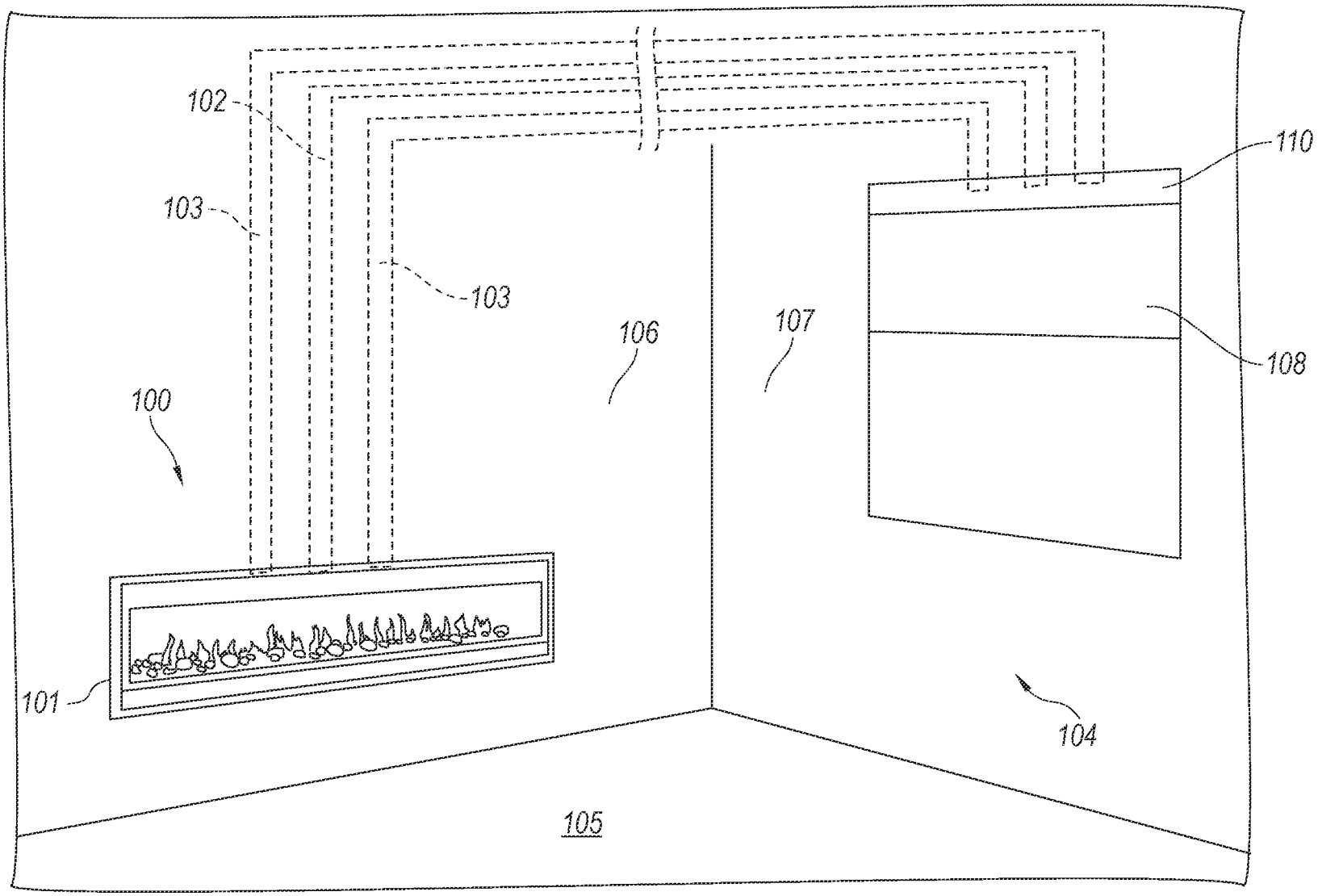
FIG. 1A is a partially schematic view of a direct vent fireplace system having an exhaust and air intake system with a low-profile manifold assembly configured in accordance with embodiments of the present technology.

FIG. 1A is an isometric and partially schematic view of a gas-burning, direct vent fireplace system 100 that includes a fireplace 101 mounted in an internal wall 106 of a room 105 in a building 104. The fireplace system 100 receives fuel (e.g., natural gas, propane, wood, etc.) and takes in combustion air from outside of the building 104 to mix with the fuel in the firebox. The combustion of the fuel and the combustion air generates exhaust gases, which are removed from the firebox and expelled outside of the building 104 into the ambient air. In representative embodiments, the fireplace system 100 is a direct vent fireplace system, such as a gas-burning fireplace system. Examples of direct vent systems are described in U.S. patent application Ser. No. 14/639,935, titled "Modular Linear Fireplace System, Assemblies and Methods," filed Mar. 5, 2015, which is incorporated herein in its entirety by reference thereto.

The fireplace 101 is fluidly coupled to an exhaust flue 102, which removes exhaust gases from the fireplace 101 to the outside ambient air. The fireplace 101 is also fluidly coupled to one or more air intake conduits 103, which provides combustion air from the outside ambient air to the fireplace 101. Along with the fireplace 101, at least portions of the exhaust flue 102 and the one or more air intake conduits 103 are typically installed within the internal wall 106 of the building 104. However, the internal wall 106 is sometimes positioned away from the exterior of the building 104. Coupling the fireplace 101 to the outside ambient air can be difficult because space can be limited within the building's walls, as well as between the ceilings and adjacent floors. In the illustrated embodiment, the fireplace 101 is installed in internal wall 106 spaced apart from an external wall and not in direct contact with the outside air. Accordingly, coupling the fireplace 101 to the outside air requires that the exhaust flue 102 and the air intake conduits 103 extend from the internal wall 106 to an external wall 107 of the building 104.

Figure 1B:
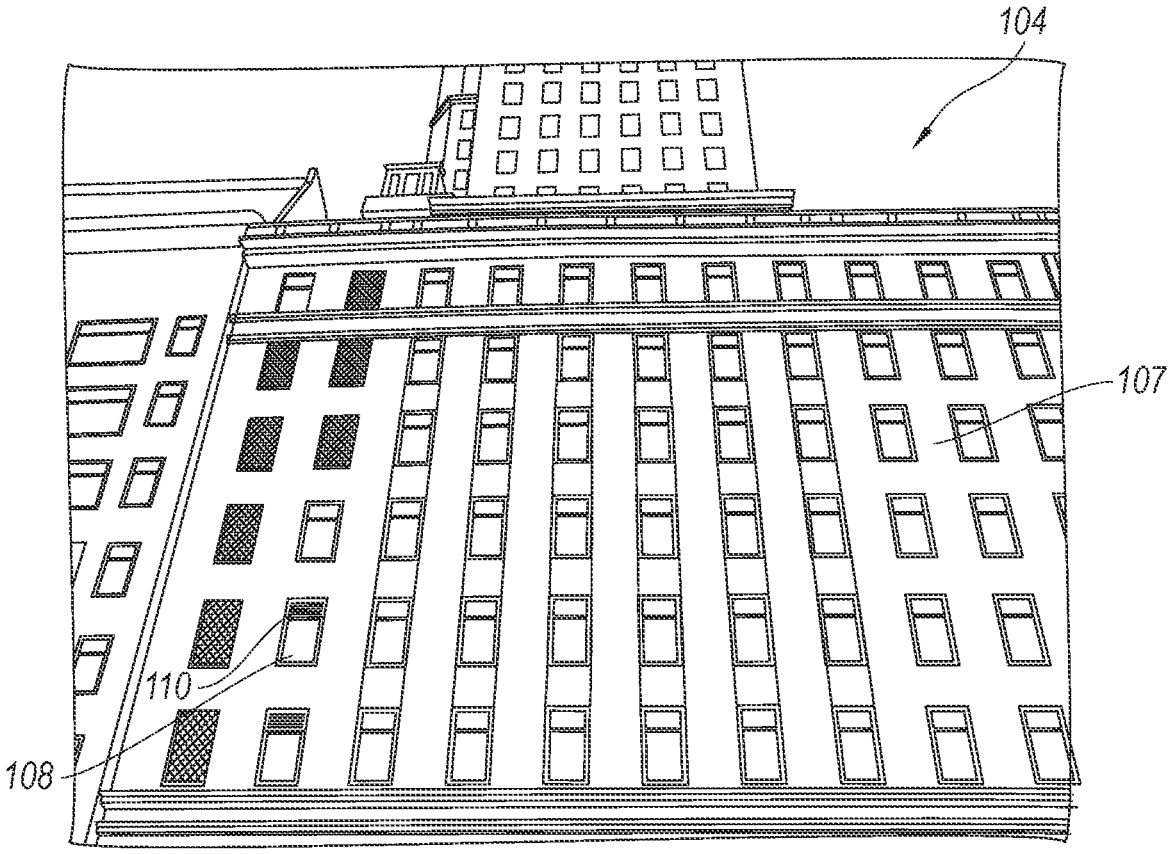
FIG. 1B is an isometric view of a building with multiple rooms in which the direct vent fireplace systems of FIG. 1A are installed.

The fireplace system 100 includes a low-profile manifold assembly 110 fluidly coupled to the exhaust flue 102 and the air intake conduits 103. The manifold assembly 110 is typically installed within the external wall 107 of the building 104 in direct communication with the outside ambient air, while not being visible from within the room 105. The manifold assembly 110 has at least one exhaust portion and at least one air intake portion exposed to the outside ambient air. With this arrangement, the manifold assembly 110 can expel exhaust gases received from the exhaust flue 102 into the outside ambient air and can take in ambient air to the air intake conduits 103 for use as combustion air in the firebox. In the illustrated embodiment, the manifold assembly 110 is positioned above a window 108 formed in the building's external wall 107 remote from the fireplace 101. As shown in FIG. 1B, the manifold assembly 110 is directly exposed to the outside ambient air. The manifold assembly 110 is positioned above the window 108 in a configuration that aesthetically blends in nicely on the exterior wall. In other embodiments, the manifold assembly 110 can be positioned below the window 108 or can be positioned away from the window 108.

Figure 2:
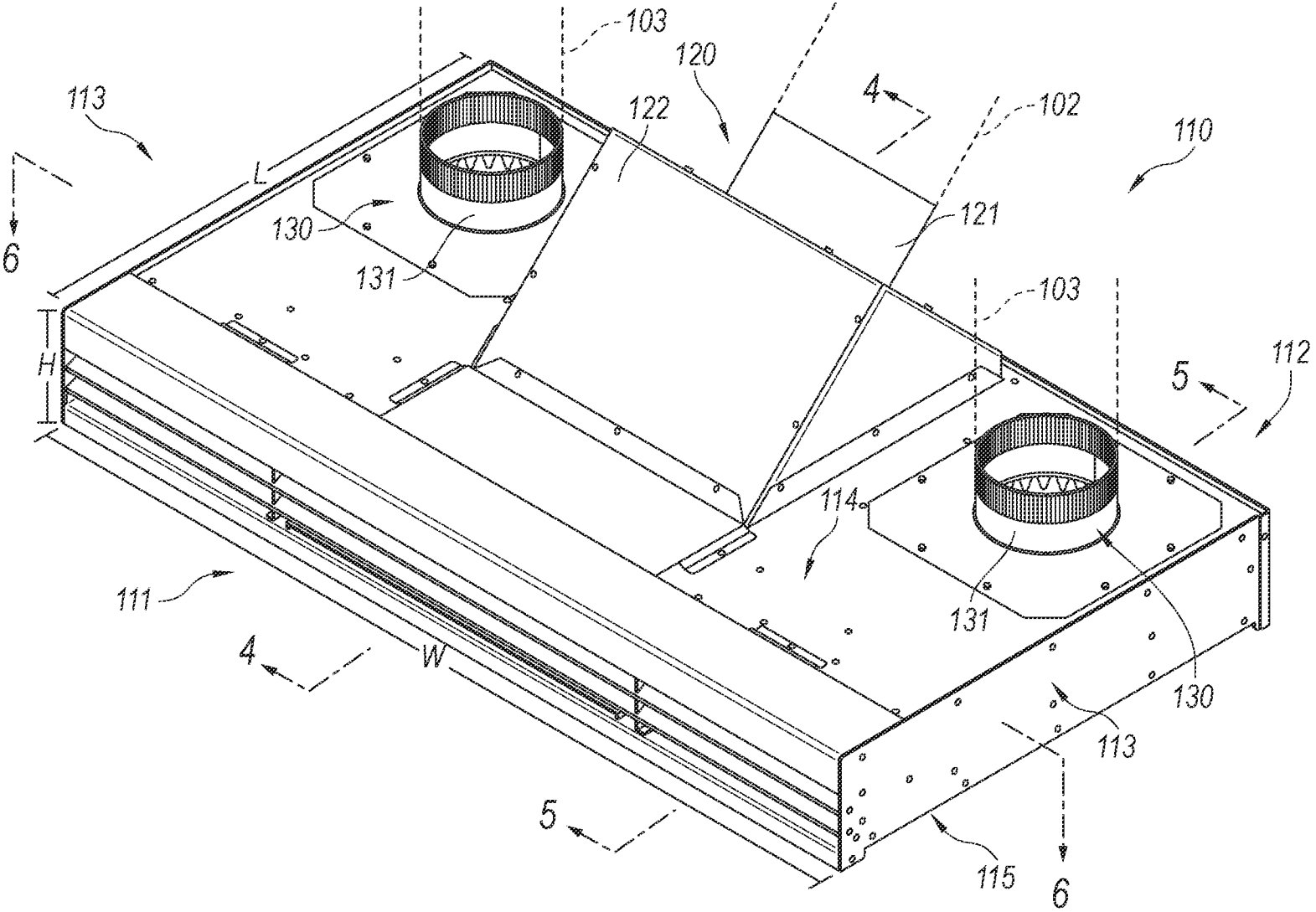
FIG. 2 is an isometric view of the low-profile manifold assembly of the fireplace system of FIG. 1A in accordance with embodiments of the present technology.

The manifold assembly 110 of the illustrated embodiment has a low-profile shape to reduce the amount of space required at the external wall. As shown in FIG. 2, the manifold assembly 110 has a generally rectangular shape that includes a body portion 105 defined by a front portion 111, a rear wall 112 that opposes the front portion 111, opposing side walls 113, and opposing top and bottom walls 114 and 115, respectively. To ensure that the manifold assembly 110 has a low-profile shape and can fit within the confines of the external wall 107, the body portion 105 of the manifold assembly 110 can be sized and shaped such that its width W is substantially as wide as the window 108, the depth or length L is less than the depth of the space available at the opening of the external wall 107 above the window, and the height H is only a few inches tall to minimize the vertical space needed above the window. In this way, the manifold assembly 110 can be compact and can be installed within the external wall 107 without requiring a large amount of space. In some embodiments, the width W can be approximately 48 inches, the height H can be approximately 4 inches, and the length L can be approximately 26 inches. In other embodiments, the width W can be between 40 inches and 60 inches, the height H can be between 3 and 12 inches, and the length L can be between 20 and 30 inches. Other embodiments can have other dimensions.

The manifold assembly 110 can include mounting tabs or other support features attached to the body portion 105 and configured to be securely affixed or otherwise coupled to the building to securely mount the body portion 105 to the building at the selected opening. In one embodiment, the mounting tabs are provided on the corners and/or edges of the body portion 105, and the tabs are configured to attach to Unistrut® connectors or other mounting features connectable to the building. Other embodiments can include other mounting features.

The body portion 105 of the manifold assembly 110 can also include attachment portions adjacent to the front opening and configured for connecting to flashing and/or other water and weatherproofing features when the manifold assembly 110 is installed in the building. The attachment portions may be brackets or other connectors coupled to the body portion. In other embodiments, the attachment portions may be features integral to the body and configured to be directly or indirectly attached to flashing or other water/weatherproofing around the perimeter of the interface between the front of the manifold assembly 110 and the building.

To control the flow of exhaust gases and combustion air through the manifold assembly 110, the manifold assembly 110 includes an exhaust portion 120 and one or more air intake portions 130 fluidly separated from the exhaust portion 120, so the exhaust gases do not mix with the combustion air. The exhaust portion 120 includes a connection housing 122 attached to the top wall 114, and an exhaust collar 121 extends from the connection housing 122 at a selected angle. The exhaust collar 121 substantially sealably connects to the exhaust flue 102. Similarly, each of the air intake portions 130 can include an air intake collar 131 coupled to the top wall 114 and configured to substantially sealably connect to one of the air intake conduits 103. During operation of the fireplace system 101, exhaust gases from the firebox travel through the exhaust flue 102 and enter the exhaust portion 120 by passing through the exhaust collar 121, through the connection housing 122, and through an exhaust chamber of the body 105 before being expelled through the body's front portion 111. At the same time, ambient air enters the air intake portions 130 by passing through the body's front portion 111 and through the air intake collar 131 to the air intake conduits 103, which provide the combustion air for the firebox to use during combustion.

Figure 3:
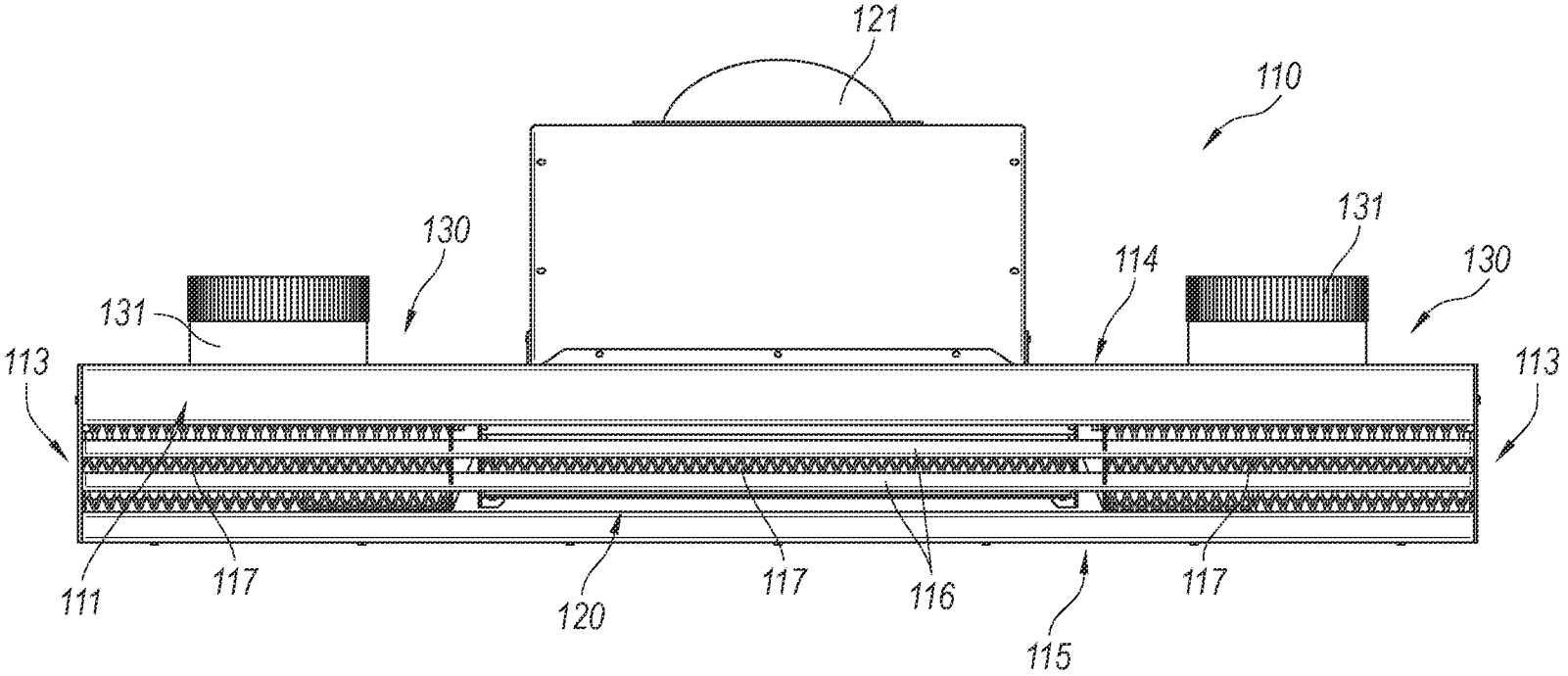
FIG. 3 is a front elevation view of the low-profile manifold assembly of FIG. 2.

FIG. 3 shows a front elevation view of the manifold assembly 110. The manifold assembly 110 includes louvers 116 that extend along the width W of the manifold assembly 110 and configured to direct the flow of exhaust gases being expelled from the manifold assembly 110 away from nearby windows. Additionally, the louvers 116 are configured to control airflow into the air intake portions 130 so that the air pressure of air entering the manifold assembly 110 can be managed. The manifold assembly 110 also includes screens 117 positioned in front of both the air intake portions 130 and the exhaust portion 120 and configured to prevent dirt and other debris from entering the manifold assembly 110.

Figure 4:
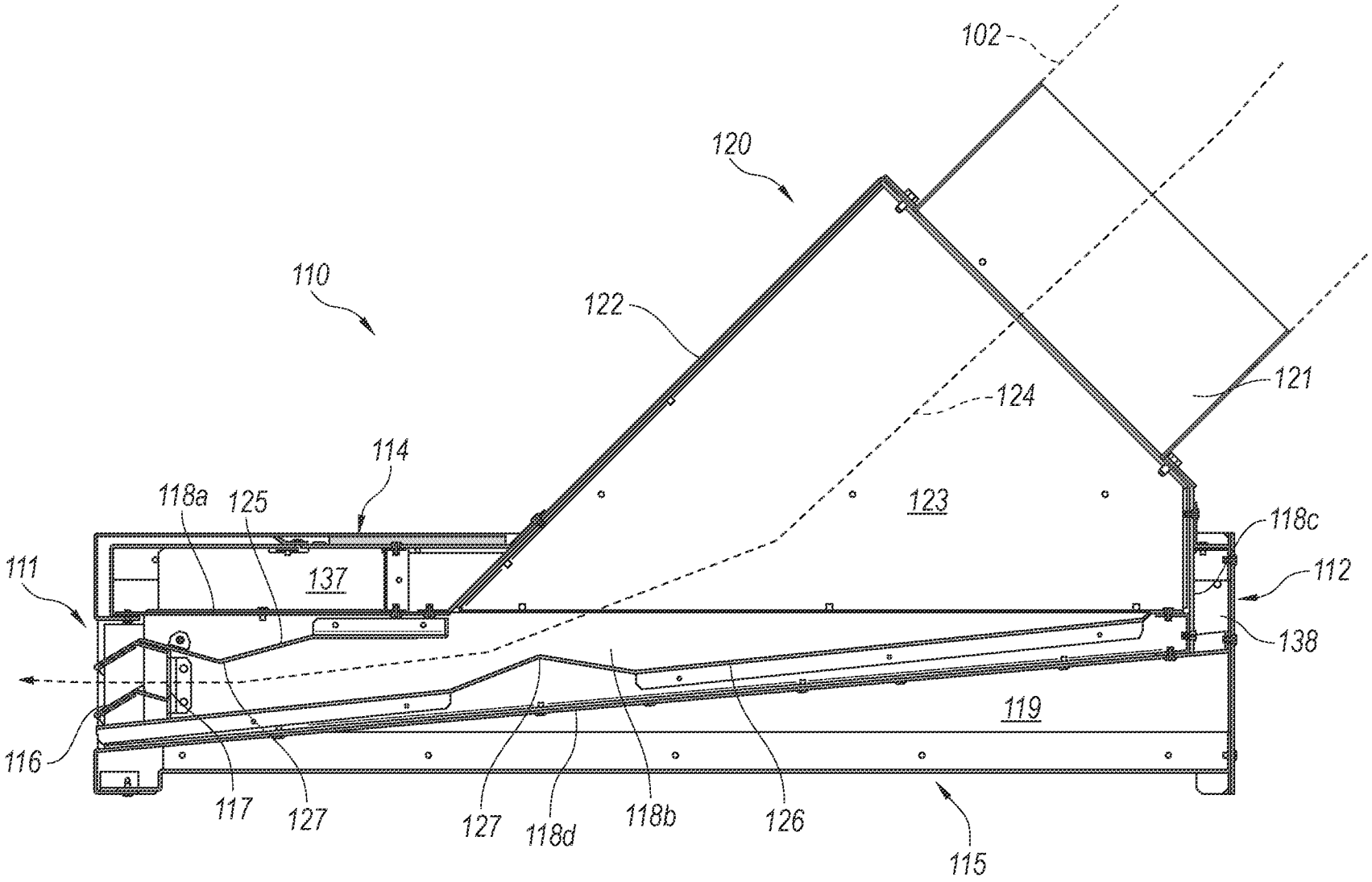
FIG. 4 is a cross-sectional view of an exhaust portion of the low-profile manifold assembly taken substantially along line 4-4 of FIG. 2.

As seen in FIG. 4, the exhaust portion 120 includes an exhaust chamber 123 configured to receive exhaust gases from the exhaust flue 102. During operation of the manifold assembly 110, the exhaust gases pass through the exhaust collar 121, through the exhaust chamber 123, and into the exhaust portion of the body 105. The exhaust gases flow along a contained exhaust path 124 within the body 105 to the exhaust openings at the body's front portion 111 where the exhaust gases are expelled from the manifold assembly 110 into the exterior ambient air. The exhaust chamber 123, which is defined by inner walls 118*a-d*, a top deflector 125, a bottom deflector 126, and the connection housing 122, is shaped such that the exhaust gases are directed towards the front portion 111 of the manifold assembly 110 when they are expelled by the exhaust flue 102. For example, the inner wall 118*d* and the bottom deflector 126 are angled with respect to the top surface 114 such that the exhaust gases passing through the connection housing 122 are forced to pass between the top and bottom deflectors 125 and 126 as the gases follow path 124. In the illustrated embodiment, the top and bottom deflectors 125 and 126 include ridges 127 that allow the top and bottom deflectors 125 and 126 to control the direction, rate, and pressure of the exhaust gases. With this arrangement, the top and bottom deflectors 125 and 126 can help control the exhaust pressure and to minimize the effect of the air pressure and/or air pressure changes exterior of the manifold assembly 110 at the exhaust openings in the body's front portion 111. Accordingly, adverse effects of exterior air pressure at the exhaust openings, such as during windy days, can be minimized to ensure proper flow of exhaust gas through and out the manifold assembly 110.

The manifold assembly 110 is configured to cool the exhaust portion of the body 105 using the in-flow of combustion air. In the illustrated embodiment, the inner walls 118*a-d* of the exhaust chamber 123 are spaced apart from the outer walls of the manifold assembly 110. For example, the inner wall 118*d* is spaced apart from the bottom wall 115 by a bottom channel 119. Further, the inner wall 118*a* is separated from the top wall 114 by a top channel 137, while the inner wall 118*c* is separated from the rear wall 112 by a rear channel 138. Each of the channels 119, 137, and 138 are in fluid communication with the air intake portions 130. Accordingly, combustion air entering the air intake portion on one or both sides of the exhaust chamber 133 can flow on opposite sides of the exhaust portion 120, and through the bottom, top and rear channels 119, 137 and/or 138, which will draw heat away from the exhaust portion. This air flow can also be used to preheat the fresh combustion air flowing through the manifold assembly 110.

The exhaust flue 102 can be coupled to the manifold assembly 110 at a selected angle and orientation. In this way, the manifold assembly 110 can be installed while conforming to space limitations within the external wall 107 (FIGS. 1A and 1B). In the illustrated embodiment, the connection housing 122 has an angled connection panel that supports the exhaust collar 121 at a selected angle relative to the top wall 114. For example, the connection panel supports the exhaust collar 121 at an angle within the range of approximately 25°-70°, so that the exhaust flue 102 is attached to the manifold assembly at a corresponding angle. In the illustrated embodiment, the connection panel that supports the exhaust collar 121 is at an angle of approximately 45° relative to the top wall 114, although other angles could be used. In other embodiments, however, the connection housing 122 is a rear-mount housing with the connection panel that orients the exhaust collar to extend rearwardly (i.e., so longitudinal axes of the exhaust collar and the attaching portion of the exhaust flue can be substantially parallel to the body's top wall 114). In yet other embodiments, the connection housing 122 is a top-mount housing with the connection panel that orients the exhaust collar to extend upwardly. For example, longitudinal axes of the exhaust collar and the attaching portion of the exhaust flue will be substantially normal to the body's top wall 114.

Figure 5:
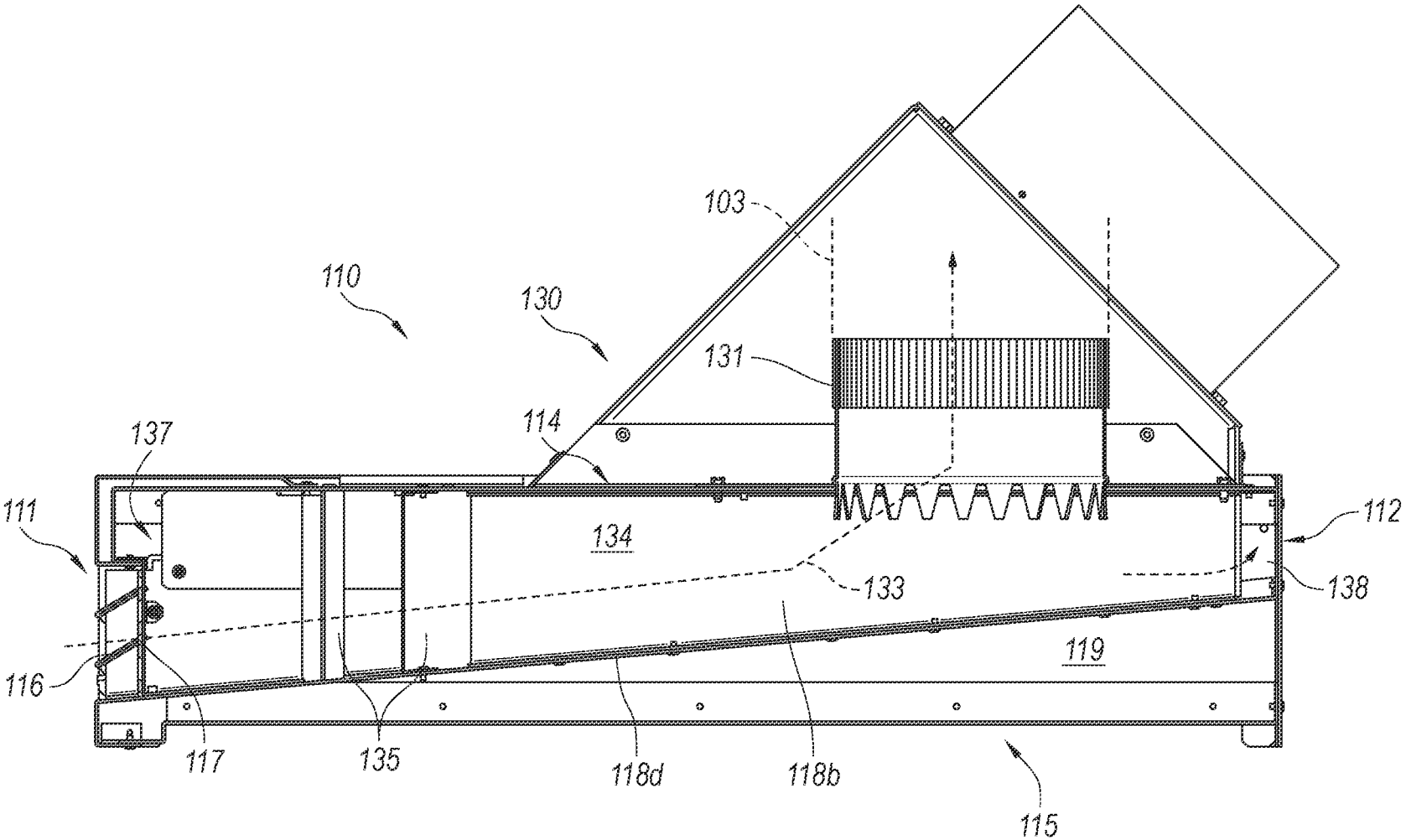
FIG. 5 is a cross-sectional view of an air intake portion of the low-profile manifold assembly taken substantially along line 5-5 of FIG. 2.

FIG. 5 is a side-elevation, cross-sectional view of one of the air intake portions 130. The air intake portion 130 includes an air intake chamber 134 defined by the top surface 114, inner walls 118, and one of the side walls 113 (FIG. 2). During operation of the manifold assembly 110, fresh air enters the air intake portion 130 by passing through the front surface 111. The air passes through the louvers 116 and the screen 117 and enters the air intake chamber 134, following a path 133 through the air intake collar 131 before entering the air intake conduit 103, which provides the air to the fireplace 101. The air passes along and around portions of the exhaust flue 102, which cools the exhaust flue and the exhaust gas flowing therethrough before exiting to the exterior ambient air. Deflector plates 135 can be positioned within the air intake chamber 134 and can be laterally offset from each other, such that air passing through the front surface 111 must flow around and between the deflector plates 135 before passing into the air intake chamber 134. The deflector plates 135 can reduce or otherwise control the pressure and/or velocity of air that enters the air intake chamber 134, so that the amount of combustion air provided to the fireplace 101 can be managed. Accordingly, swirls or sudden gusts of wind outside of the building will not significantly affect the amount or pressure of air that enters the air intake portion 130.

The air intake chamber 134 is shaped such that the inner wall 118*d* is angled with respect to the bottom surface 115. With this shape, the air that enters the air intake chamber 134 can be compressed as it flows along the path 133 towards the air intake collar 131. Accordingly, the pressure of the air within the air intake chamber 134 near the front surface 111 may be slightly less than the air within the air intake chamber 134 close to the air intake collar 131. Further, the increased pressure near the air intake collar 131 is typically greater than the pressure within the air intake conduit 103, and this pressure difference can help force air within the air intake chamber 134 through the air intake collar 131 and into the air intake conduit 103, while simultaneously inhibiting air within the air intake conduit 103 from flowing backward into the air intake chamber 134.

As shown in FIG. 2, the manifold assembly 110 includes two air intake portions 130 positioned on opposing sides of the exhaust portion 120 and, in some embodiments, the two air intake portions 130 can provide combustion air to the fireplace 101 using separate air intake conduits 103. However, space limitations within the internal wall 106 and/or external wall 107 can sometimes limit the ability of multiple air intake conduits 103 from accessing the manifold assembly 110 such that only a single air intake conduit 103 can be coupled to the manifold assembly 110. Accordingly, in some embodiments, only one of the air intake portions 130 is coupled to the single air intake conduit 103 while the other air intake portion 130 is closed off (e.g., with a closure plate coupled to the top surface 114), and therefore not directly coupled to an air intake conduit 103. In this way, the manifold assembly 110 can conform to space limitations within the external wall 107. To ensure that the ability of the manifold assembly 110 to provide combustion air to the fireplace 101 is not limited by not coupling a second air intake conduit 103 to the manifold assembly 110, the two air intake portions 130 can be fluidly coupled together such that air can flow between the two air intake portions 130, and the single air intake conduit 103 can supply all of the combustion air to the fireplace 101. For example, the cavity 137 and the channel 138 can fluidly couple the two air intake portions 130 and air within the air intake chamber 134 for the closed-off air intake portion 130 can flow through the cavity 137 and/or the channel 138 to reach the other air intake portion 130.

Figure 6:
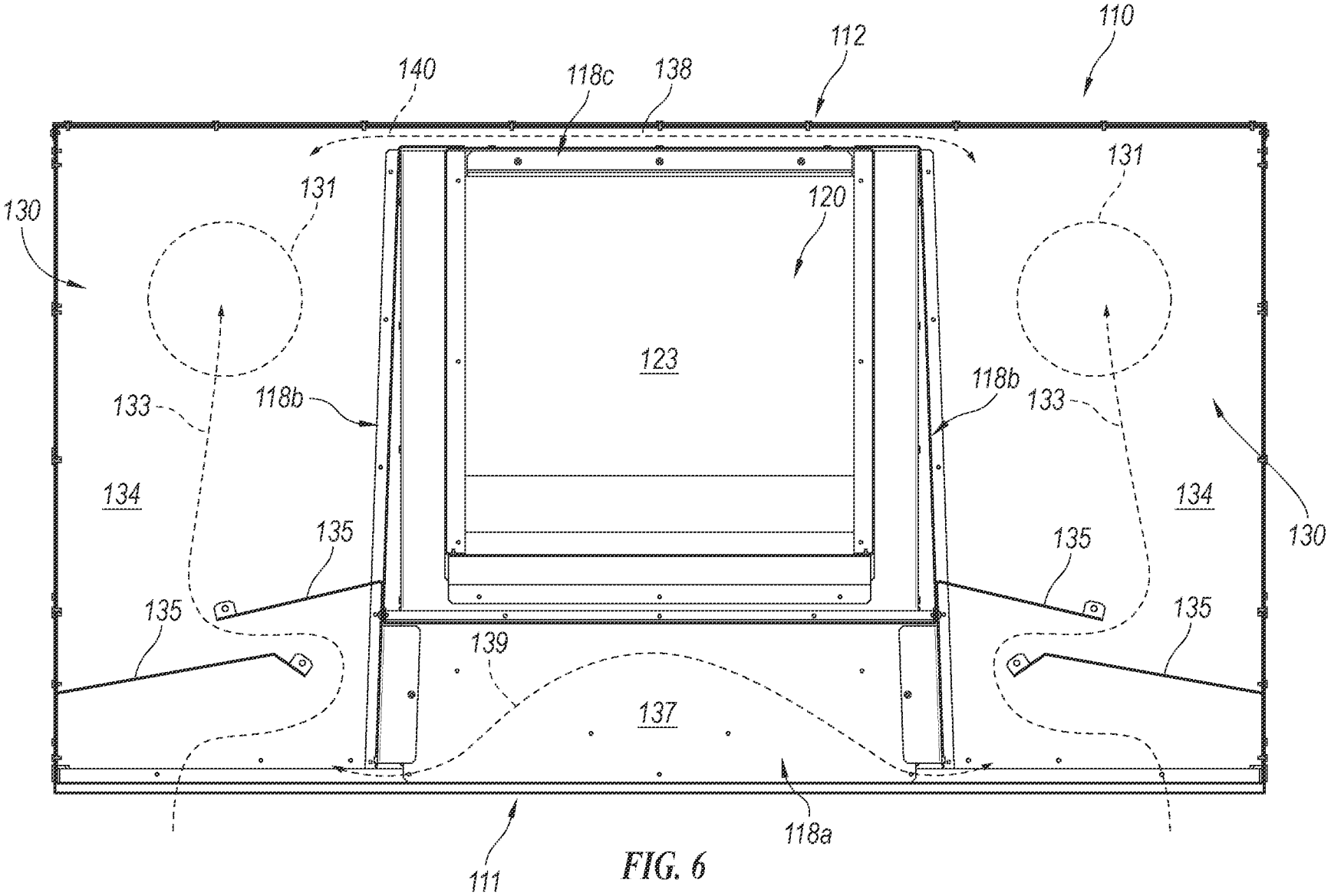
FIG. 6 is a cross-sectional view of the low-profile manifold assembly taken substantially along line 6-6 of FIG. 2.

FIG. 6 shows a cross-sectional view of the manifold assembly 110. During operation of the manifold assembly 110, most of the air that enters the air intake chambers 134 flows generally along the paths 133 and exits the air intake chambers 134 by passing through the air intake collars 131. However, some of the air may not follow paths 133. Instead, some of the air flows into the adjacent air intake chamber 134 by following either path 139, which passes through cavity 137, or path 140, which passes through channel 138. Accordingly, the fluidly connected air intake portions 130 can each provide generally similar amounts of air to the fireplace 101 because differences in air pressure between the two air intake chambers 134 can cause air to flow between the two chambers, thereby reducing the differences in pressure. Further, the air can cool portions of the manifold assembly 110 as it flows along the paths 138 and the 139. For example, when the exhaust chamber 123 receives hot exhaust gases from the fireplace 101, the inner walls 118 can heat up. However, the cavity 137 is positioned directly above a portion of the exhaust chamber 123 and air flowing along path 139 can remove heat from the inner wall 118. In some embodiments, the two air intake chambers 134 can also be fluidly connected to each other via an opening beneath the exhaust chamber 123 (e.g., cavity 119 shown in FIGS. 4 and 5). In addition, the two air intake chambers on opposite sides of the exhaust chamber act to isolate the exhaust chamber from portions of the surrounding building structure, thereby protecting the building from high temperatures from the exhaust flow.

In the illustrated embodiment, the manifold assembly 110 is configured such that the air intake conduit 103 forms an angle of approximately 90° with the top surface 114 when it is coupled to the air intake collar 131. In other embodiments, however, the air intake collar 131 can be oriented such that the air intake conduit 103 forms an angle of approximately 45° with the top surface 114. In general, the manifold assembly 110 can be configured such that the air intake conduit 103 forms any suitable angle with the top surface 114 when the air intake conduit 103 couples to the air intake collar 131.

As previously discussed, the air intake portions 130 can include one or more deflector plates 135 positioned within the air intake chambers 134. When the fireplace 101 receives air from the air intake conduits 103, the air and the fuel gas are introduced to the firebox and burned. The fireplace system 100 can be configured to provide the air and fuel gas to the firebox at selected rates so that the fire created when the mixture is burned has selected properties (e.g., heat output, size, balance, temperature, color, etc.). However, if the rates are sufficiently different from the selected rates, the fire may not have the desired properties. For example, when the fireplace system 100 is installed in a building 104 located in an area having high air pressure, the quantity of air provided to the fireplace 101 can be too large, which can cause the rate at which air is provided to the firebox to be too large, which can result in the fire being too large due to the extra oxygen. Accordingly, the deflector plates 135 can control the pressure of the air that flows into the air intake chambers 134 by increasing the length of the path 132 that the air travels to reach the air intake chamber 134 and by inhibiting high pressure air (e.g., wind gusts) from freely flowing through the front surface 111 and into the air intake chamber 134.

In the illustrated embodiment, each of the air intake portions 130 includes two deflector plates 135 arranged in an offset configuration and substantially parallel to each other. In this configuration, the deflector plates 135 are arranged such that a portion of each of the deflector plates 135 overlaps with a portion of an adjacent deflector plate 135. In other embodiments, the two deflector plates 135 can be arranged such that adjacent deflectors are not parallel to each other and/or do not overlap with each other. In general, each of the air intake portions 130 can include any suitable number of deflector plates 135 and the deflector plates 135 can be arranged in any suitable configuration.

In the illustrated embodiments, the manifold assembly 110 includes two air intake portions 130, each of which includes an air intake collar 131 coupled to different air intake conduits 103. During operation of the fireplace system 100, both air intake portions 130 provide combustion air to a single fireplace 101. In other embodiments, the manifold assembly 110 can be coupled to multiple fireplaces 101 such that the two air intake portions 130 provide combustion air to different fireplaces 101. In still other embodiments, the manifold assembly can include two different air intake chambers 134 fluidly connected to each other but may only include a single air intake collar 131. In these embodiments, air that enters one of the air intake chambers 134 can be provided to the fireplace 101 by flowing through the cavity 137 and/or channel 138 to reach the other air intake chamber 134 before passing through the air intake collar 131. For example, in embodiments for which the left air intake portion 130 includes an air intake collar 131 while the right air intake portion 130 does not, air that enters the right air intake portion 130 flows along paths 139 and 140 to enter the left air intake chamber 134. This air then mixes with the air already in the left air intake chamber 134 before passing through the air intake collar 131 and into the air intake conduit 103.

From the foregoing, it will be appreciated that specific embodiments of the invention have been described herein for purposes of illustration, but that various modifications may be made without deviating from the scope of the invention. Accordingly, the invention is not limited except as by the appended claims.

We claim:

1. A manifold assembly for use with a direct-vent fireplace system having a fireplace assembly, an exhaust flue and a combustion air conduit, the manifold assembly comprising:

a body portion having an interior area and having a front portion open to the interior area, the front portion having an open exhaust portion out of which exhaust gasses pass and having an open intake portion into which combustion air flows;

a plurality of interior dividers that divide the interior area into an exhaust chamber and a combustion air chamber isolated from and adjacent to the exhaust chamber, the exhaust chamber being connected to the exhaust portion and defining an exhaust path through the body portion, and the combustion air chamber being connected to the intake portion and defining a combustion air path through the body portion, wherein at least a portion of the combustion air path is adjacent to the exhaust chamber, wherein the combustion air cools at least a portion of a first interior divider defining a portion of the exhaust chamber to draw heat from exhaust moving along the exhaust path, at least one of the dividers being positioned adjacent to the front portion and separating the exhaust portion from the intake portion;

a plurality of louvers connected to the body portion and extending across the elongate front portion, the louvers configured to direct combustion air into the combustion air chamber, and to direct exhaust from the exhaust chamber out of the exhaust portion;

an exhaust connection member attached to the body portion and having an exhaust collar connectable to the exhaust flue and configured to direct exhaust along the exhaust path into the interior area; and an air intake collar coupled to the body portion and connectable to the combustion air conduit and configured to receive a flow of combustion air exiting from the combustion air chamber;

wherein the intake portion is a first intake portion on a first side of the exhaust chamber, the open front portion having a second intake portion on a second side of the exhaust opening opposite the first intake portion, and the combustion air chamber is in fluid communication with the first and second intake portions to receive combustion air therethrough.

2. The manifold assembly of claim 1 wherein the air intake collar is a first air intake collar coupled to the body portion and in fluid communication with a first portion of the combustion air chamber to form a first combustion air path through the body portion, and the manifold assembly further comprising a second air intake collar coupled to the body portion and in fluid communication with a second portion of the combustion air chamber to form a second combustion air path through the body portion, wherein the first and second combustion air paths are fluidly isolated from the exhaust path.

3. A manifold assembly for use with a direct-vent fireplace system having a fireplace assembly, an exhaust flue and a combustion air conduit, the manifold assembly comprising:

a body portion having an interior area and having a front portion open to the interior area, the front portion having an open exhaust portion out of which exhaust gasses pass and having an open intake portion into which combustion air flows;

a plurality of interior dividers that divide the interior area into an exhaust chamber and a combustion air chamber isolated from and adjacent to the exhaust chamber, the exhaust chamber being connected to the exhaust portion and defining an exhaust path through the body portion, and the combustion air chamber being connected to the intake portion and defining a combustion air path through the body portion, wherein at least a portion of the combustion air path is adjacent to the exhaust chamber, wherein the combustion air cools at least a portion of a first interior divider defining a portion of the exhaust chamber to draw heat from exhaust moving along the exhaust path, at least one of the dividers being positioned adjacent to the front portion and separating the exhaust portion from the intake portion;

a plurality of louvers connected to the body portion and extending across the elongate front portion, the louvers configured to direct combustion air into the combustion air chamber, and to direct exhaust from the exhaust chamber out of the exhaust portion;

an exhaust connection member attached to the body portion and having an exhaust collar connectable to the exhaust flue and configured to direct exhaust along the exhaust path into the interior area; and an air intake collar coupled to the body portion and connectable to the combustion air conduit and configured to receive a flow of combustion air exiting from the combustion air chamber;

wherein the air intake collar is a first air intake collar coupled to the body portion and in fluid communication with a first portion of the combustion air chamber, and the manifold assembly further comprising a second air intake collar coupled to the body portion and in fluid communication with a second portion of the combustion air chamber, wherein the exhaust chamber is between the first and second portions of the combustion air chamber.

4. The manifold assembly of claim 1, further comprising air deflector plates positioned in the combustion air chamber, wherein the deflector plates are positioned to redirect combustion air flowing along the combustion air path through the body portion.

5. A manifold assembly for use with a direct-vent fireplace system having a fireplace assembly, an exhaust flue and a combustion air conduit, the manifold assembly comprising:

a body portion having an interior area and having a front portion open to the interior area, the front portion having an open exhaust portion out of which exhaust gasses pass and having an open intake portion into which combustion air flows;

a plurality of interior dividers that divide the interior area into an exhaust chamber and a combustion air chamber isolated from and adjacent to the exhaust chamber, the exhaust chamber being connected to the exhaust portion and defining an exhaust path through the body portion, and the combustion air chamber being connected to the intake portion and defining a combustion air path through the body portion, wherein at least a portion of the combustion air path is adjacent to the exhaust chamber, wherein the combustion air cools at least a portion of a first interior divider defining a portion of the exhaust chamber to draw heat from exhaust moving along the exhaust path, at least one of the dividers being positioned adjacent to the front portion and separating the exhaust portion from the intake portion;

a plurality of louvers connected to the body portion and extending across the elongate front portion, the louvers configured to direct combustion air into the combustion air chamber, and to direct exhaust from the exhaust chamber out of the exhaust portion;

an exhaust connection member attached to the body portion and having an exhaust collar connectable to the exhaust flue and configured to direct exhaust along the exhaust path into the interior area;

an air intake collar coupled to the body portion and connectable to the combustion air conduit and configured to receive a flow of combustion air exiting from the combustion air chamber; and air deflector plates positioned in the combustion air chamber, wherein the deflector plates are positioned to redirect combustion air flowing along the combustion air path through the body portion;

wherein the air deflector plates are positioned substantially parallel to each other and arranged in an offset configuration with a portion of a first deflector plate positioned in an overlapping arrangement with an adjacent second deflector plate.

6. The manifold assembly of claim 1, further comprising top and bottom deflectors in the interior area spaced apart from top and bottom surfaces of the body portion and coupled to the interior dividers to define the exhaust chamber.

7. The manifold assembly of claim 6 wherein the bottom deflector is in a non-parallel orientation relative to the bottom surface and configured to direct the exhaust from the exhaust connection member toward the opening.

8. The manifold assembly of claim 6 wherein a portion of the combustion air portion extends between the bottom deflector and the bottom surface of the body portion.

9. The manifold assembly of claim 1 wherein the body portion has opposing top and bottom surfaces separated by a distance in the range of approximately 4-8 inches to form a low profile shape.

10. A manifold assembly for use with a direct-vent fireplace system having a fireplace assembly, an exhaust flue and a combustion air conduit, the manifold assembly comprising:

a body portion having an interior area and having a front portion open to the interior area, the front portion having an open exhaust portion out of which exhaust gasses pass and having an open intake portion into which combustion air flows;

a plurality of interior dividers that divide the interior area into an exhaust chamber and a combustion air chamber isolated from and adjacent to the exhaust chamber, the exhaust chamber being connected to the exhaust portion and defining an exhaust path through the body portion, and the combustion air chamber being connected to the intake portion and defining a combustion air path through the body portion, wherein at least a portion of the combustion air path is adjacent to the exhaust chamber, wherein the combustion air cools at least a portion of a first interior divider defining a portion of the exhaust chamber to draw heat from exhaust moving along the exhaust path, at least one of the dividers being positioned adjacent to the front portion and separating the exhaust portion from the intake portion;

a plurality of louvers connected to the body portion and extending across the elongate front portion, the louvers configured to direct combustion air into the combustion air chamber, and to direct exhaust from the exhaust chamber out of the exhaust portion;

an exhaust connection member attached to the body portion and having an exhaust collar connectable to the exhaust flue and configured to direct exhaust along the exhaust path into the interior area;

an air intake collar coupled to the body portion and connectable to the combustion air conduit and configured to receive a flow of combustion air exiting from the combustion air chamber; and air deflector plates positioned in the combustion air chamber, wherein the deflector plates are positioned to redirect combustion air flowing along the combustion air path through the body portion;

wherein the exhaust connection member is configured wherein a longitudinal axis of the exhaust collar is at a selected angle in the range of approximately 90 degrees-180 degrees relative to the top surface of the body portion.

11. A direct-vent fireplace system for use in a room with an exterior wall having a wall opening to exterior ambient air, the system comprising:

a direct-vent, gas burning fireplace;

an exhaust flue and a combustion air conduit connected to the fireplace, the exhaust flue carrying exhaust from the fireplace, and the combustion air conduit carrying air to the fireplace;

a low-profile manifold assembly remote from the fireplace, with the exhaust flue and combustion air conduit extending between the fireplace and the manifold assembly, the manifold assembly comprising:

a body portion couplable to the exterior wall at the wall opening, the body portion having an interior area and having a front portion positioned adjacent to the wall opening, the front portion being open to the interior area, the front portion having an open exhaust portion out of which exhaust gasses pass and having an open intake portion into which combustion air flows from the exterior ambient air;

interior dividers that divide the interior area into an exhaust chamber and a combustion air chamber, the exhaust chamber being connected to the exhaust portion and defining an exhaust path through the body portion, and the combustion air chamber being connected to the intake portion and defining a combustion air path through the body portion, wherein at least a portion of the combustion air path is adjacent to the exhaust chamber, at least one of the dividers being positioned adjacent to the front portion and separating the exhaust portion from the intake portion;

an exhaust connection member attached to the body portion and having an exhaust collar connectable to the exhaust flue and configured to direct exhaust along the exhaust path into the interior area; and an air intake collar coupled to the body portion and connectable to the combustion air conduit and configured to receive combustion air exiting the combustion air chamber;

wherein the intake portion is a first intake portion on a first side of the exhaust chamber, the open front portion having a second intake portion on a second side of the exhaust opening opposite the first intake portion.

12. The system of claim 11, further comprising a plurality of louvers connected to the body portion and extending across the front portion, the louvers being configured to direct combustion air through the intake portion into the combustion air chamber and to control pressure therein, and to direct exhaust from the exhaust chamber out of the exhaust portion.

13. The manifold assembly of claim 11, further comprising top and bottom deflectors in the interior area spaced apart from top and bottom surfaces of the body portion and connected to the interior dividers to define the exhaust chamber, the bottom deflector is in a non-parallel orientation relative to the bottom surface and configured to direct the exhaust from the exhaust connection member toward the opening.

14. The manifold assembly of claim 13 wherein the top deflector is oriented at a non-parallel orientation relative to the top surface and relative to the bottom deflector.

15. The manifold assembly of claim 13 wherein a portion of the combustion air portion of the interior area through which combustion air flows extends between the bottom deflector and the bottom surface of the body portion.

16. The manifold assembly of claim 11, wherein the body portion has a height in the range of approximately 3 inches-12 inches, a width in the range of approximately 40 inches-60 inches, and a length in the range of approximately 20 inches-30 inches.

17. A manifold assembly for use with a direct-vent fireplace system having a direct-vent fireplace assembly with an exhaust flue and a combustion air intake conduit, the manifold assembly comprising:

a body portion having an interior area and having an open front portion;

one or more interior dividers that divide the interior area into an exhaust chamber and a combustion air chamber isolated from and adjacent to the exhaust chamber, and each being connected to separate portion of the open front portion, the exhaust chamber having an exhaust path therethrough, and the combustion air portion having a combustion air path therethrough, wherein the combustion air path is fluidly isolated from the exhaust path within the body portion, wherein at least a portion of the combustion air path is positioned so the combustion air cools at least a portion of a first interior divider defining a portion of the exhaust chamber;

a plurality of louvers connected to the body portion and extending across the elongate opening, the louvers configured to direct combustion air through the intake portion into the combustion air portion and to control pressure therein, and to direct exhaust from the exhaust portion out of the body portion;

an exhaust connection member attached to the body portion and having an exhaust collar connectable to the exhaust flue and configured to direct exhaust along the exhaust path into the interior area;

an air intake collar coupled to the body portion and connectable to the combustion air conduit, and configured to receive a flow of combustion air exiting the combustion air chamber;

wherein the intake portion is a first intake portion on a first side of the exhaust chamber, the open front portion having a second intake portion on a second side of the exhaust opening opposite the first intake portion, and the combustion air chamber is in fluid communication with the first and second intake portions to receive combustion air therethrough into the combustion air chamber.

18. A manifold assembly for use with a direct-vent fireplace system having a direct-vent fireplace assembly with an exhaust flue and a combustion air intake conduit, the manifold assembly comprising:

a body portion having an interior area and having an open front portion;

one or more interior dividers that divide the interior area into an exhaust chamber and a combustion air chamber isolated from and adjacent to the exhaust chamber, and each being connected to a separate portion of the open front portion, the exhaust chamber having an exhaust path therethrough, and the combustion air portion having a combustion air path therethrough, wherein the combustion air path is fluidly isolated from the exhaust path within the body portion, wherein at least a portion of the combustion air path is positioned so the combustion air cools at least a portion of a first interior divider defining a portion of the exhaust chamber;

a plurality of louvers connected to the body portion and extending across the elongate opening, the louvers configured to direct combustion air through the intake portion into the combustion air portion and to control pressure therein, and to direct exhaust from the exhaust portion out of the body portion;

an exhaust connection member attached to the body portion and having an exhaust collar connectable to the exhaust flue and configured to direct exhaust along the exhaust path into the interior area;

an air intake collar coupled to the body portion and connectable to the combustion air conduit, and configured to receive a flow of combustion air exiting the combustion air chamber;

wherein the air intake collar is a first air intake collar coupled to the body portion and in fluid communication with a first portion of the combustion air chamber, and the manifold assembly further comprising a second air intake collar coupled to the body portion and in fluid communication with a second portion of the combustion air chamber, wherein the exhaust chamber is between the first and second portions of the combustion air chamber.

* * * * *